United States Patent [19]

Staples

[11] 3,940,043

[45] Feb. 24, 1976

[54] ADJUSTABLE-BOW BAR OR ROLL AXLE

[75] Inventor: Robert E. Staples, Lakeville, Mass.

[73] Assignee: Mount Hope Machinery Company, Taunton, Mass.

[22] Filed: May 6, 1974

[21] Appl. No.: 467,151

Related U.S. Application Data

[63] Continuation-in-part of Ser. No. 365,055, May 30, 1973, abandoned.

[52] U.S. Cl. ..... 226/192; 26/63; 29/116 AD; 226/199

[51] Int. Cl.[2] ..... B65H 17/20

[58] Field of Search ..... 226/97, 190, 192, 197, 226/199; 29/116 AD; 26/63

[56] References Cited

UNITED STATES PATENTS

| | | | |
|---|---|---|---|
| 2,054,214 | 9/1936 | Buss | 26/63 UX |
| 2,692,773 | 10/1954 | Lorig | 226/192 |
| 3,328,866 | 7/1967 | Robertson | 29/116 AD |
| 3,500,524 | 3/1970 | Jagminas | 26/63 X |

*Primary Examiner*—Richard A. Schacher
*Attorney, Agent, or Firm*—Kenway & Jenney

[57] ABSTRACT

An adjustable-bow bar or roll axle, useful for spreading slit sheets of paper and for other purposes, includes a hollow cylindrical shell. Two tension bolts extend along axes parallel to the centerline of the shell, and interconnect the ends of the bar or axle. One of the bolts lies in a plane of desired curvature of the bar and applies a bending moment to curve the bar in this plane; this bolt may be located inside or outside the shell, depending on the required bending moment. The second bolt may be inside the shell; its angular position is adjustable with respect to that of the first. This bolt is set in the plane of a resultant force applied to the bar by the tension in the sheet, and applies a bending moment to offset this force and prevent curvature of the bar in this plane. A third bolt may be located in a vertical plane to apply a bending moment to prevent curvature of the bar by its weight; or the second bolt may serve this purpose also.

13 Claims, 11 Drawing Figures

ADJUSTABLE-BOW BAR OR ROLL AXLE

BACKGROUND AND BRIEF DESCRIPTION OF THE INVENTION

This application is a continuation-in-part of my copending U.S. Patent application Ser. No. 365,055, filed on May 30, 1973, now abandoned.

This invention relates to bow bars and curved roll axles. Bow bars, among other purposes, are used in the paper industry for separating the several strips of a slit sheet between the slitting cutters and the reel of a slitting machine. This is done to prevent the edges of the slit sheets from interleaving with each other during winding, which would make the completed rolls difficult to separate. Devices of this type are described, for example, in U.S. Pat. Nos. 3,463,377 and 3,719,316.

Some bow bars and curved rolls are adjustable in their degree of bow, to control the amount of spreading they produce. In the case of bow bars used for separating slit sheets, for example, this allows for changes in the number of slits to be cut in a sheet of given width. In the case of curved rolls used for spreading textiles, as another example, this allows the spreading action to be adjusted. It is with such adjustable-bow bars and roll axles that this invention is concerned.

The amount of bow required in these bars or rolls is in many cases quite small, often not over 1% of the face width of the bar or roll, and often much less than this. The action of these devices is entirely produced by the geometry of the bow; that is, by the amount of bow and the orientation of the plane of the bow with respect to the sheet. It will therefore be appreciated that where the total bow is small, (that is, the radius of curvature is relatively large), the amount and direction of the bow must be held within close limits.

A shortcoming of presently-known bow bars and roll axles intended to have small amounts of bow is that random, unintended deflections of the bar, produced by sheet tension and by the weight of the bar itself, may be of the same order of magnitude as the amount of bow required. The forces which produce these undesirable components of deflection of the bar often do not lie in the direction of the plane of the required bow. In addition, the sheet tension and the resultant component of force which it applies to the bar often vary over wide limits, because of variations in the physical characteristics of the sheets which are run over the bar.

The net effect of sheet tension and the weight of the bar is thus seriously to alter the direction and magnitude of the resultant curvature of the bar, in a manner which affects its performance most adversely.

An object of this invention is to eliminate these undesired components of deflection of the bar or roll axle.

A further object of the invention is to provide a bow correction which is easily adjustable in magnitude to compensate for variations in sheet tension.

A further object of the invention is to provide a bow correction which is adjustable in its direction of action, to compensate for variable sheet tension and/or the force of gravity.

A further object of one embodiment of the invention is to provide bow corrections which are substantially independent of each other and of the magnitude of the desired bow, to compensate for the effects of sheet tension and the force of gravity.

A further object of another embodiment of the invention is to provide a convenient means for independently adjusting the direction of desired bow and the direction of bow correction.

Briefly stated, the invention is carried out in preferred embodiments by extending at least two bolts, or other equivalent devices such as hydraulic rams for applying longitudinal compression or tension, lengthwise of a hollow cylindrical shell along axes parallel to its centerline or major axis. One of these devices, which may be inside or outside the shell depending on the lever arm needed to produce the required bending moment, lies in a plane of desired bow or curvature of the bar, and applied a bending moment to curve the shell in this plane. The second device lies in the plane of the resultant force applied to the bar by the tension in the sheet, and applies a bending moment to offset this force and correct curvature of the shell induced thereby. According to a feature of the invention, the angular position of the second device with respect to that of the first is adjustable, so that a change in the orientation of the bar of the wrap of the sheet can be compensated for. A third bolt or equivalent device may be extended through the shell on a vertical plane, to correct sag caused by the weight of the bar; but the virtue of adding such a third device is in proportion to the length and weight of the given bar. In some cases it is feasible to use the second device to correct for sag as well as sheet forces.

DESCRIPTION OF THE DRAWINGS

While the specification concludes with claims particularly pointing out the subject matter which I regard as my invention, it is believed that a clearer understanding may be gained from the following description preferred embodiments thereof, referring to the accompanying drawings, in which:

Figure 1:
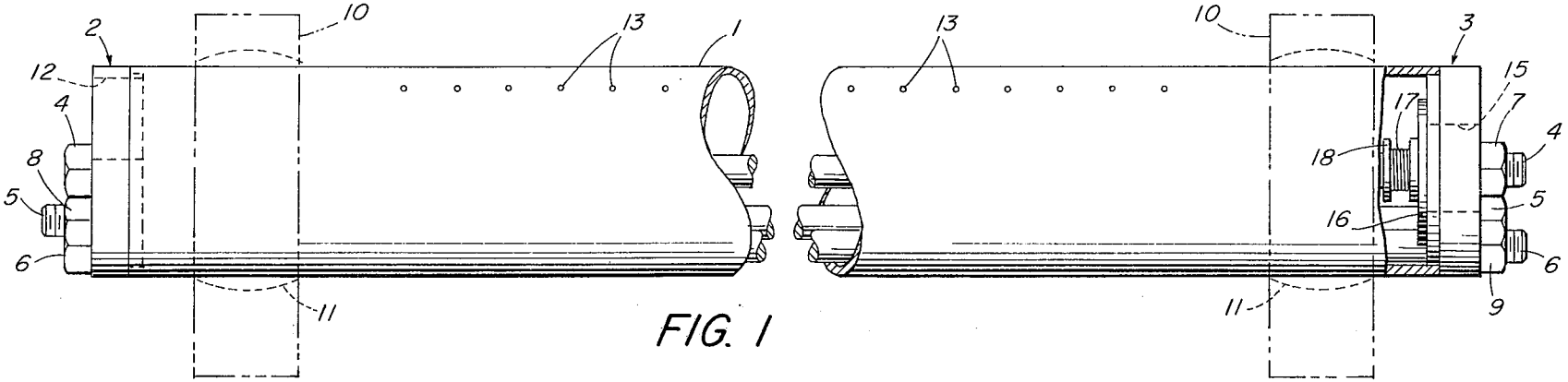
FIG. 1 is a fragmentary, partially sectional view in front elevation of a first embodiment of the invention in an adjustable-bow bar.

Referring first to FIGS. 1–4, a first embodiment of the invention in an adjustable-bow bar includes a hollow cylindrical shell 1 provided with end caps 2 and 3. Bolts 4, 5, and 6 extend the length of the bar parallel to its centerline through the end caps, and are threaded at one end and provided with nuts 7, 8, and 9 respectively. All three of these bolts are located adjacent the inside diameter of the shell 1. The angular orientation of the bolt 4 is such that it lies in the desired plane A of the curvature or bow of the bar; that of the bolt 5 is such that it lies in the plane B of the resultant force produced by sheet tension acting on the bar; and that of the bolt 6 is such that it lies in a vertical plane C at the bottom of the shell 1.

The shell 1 is supported by brackets shown schematically at 10, which may include spherical mounts 11, well known in the art of curved rolls and bow bars, to allow the shell to be bowed as desired without a restraining moment being introduced by the support brackets.

The end cap 2 is provided with a pipe-threaded hole 12, through which pressurized air is admitted to the interior of the shell 1. The shell is provided with a plurality of holes 13 spaced longitudinally along and angularly about the shell, and generally covering the portion of the surface of the shell which is to be wrapped by the sheet.

Figure 2:
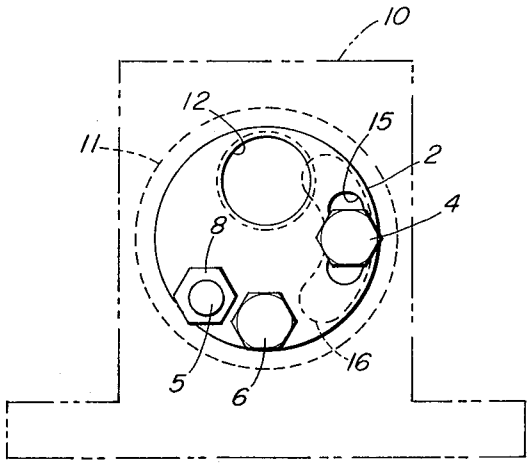
FIG. 2 is a view in left side elevation of the bar of FIG. 1.
Figure 4:
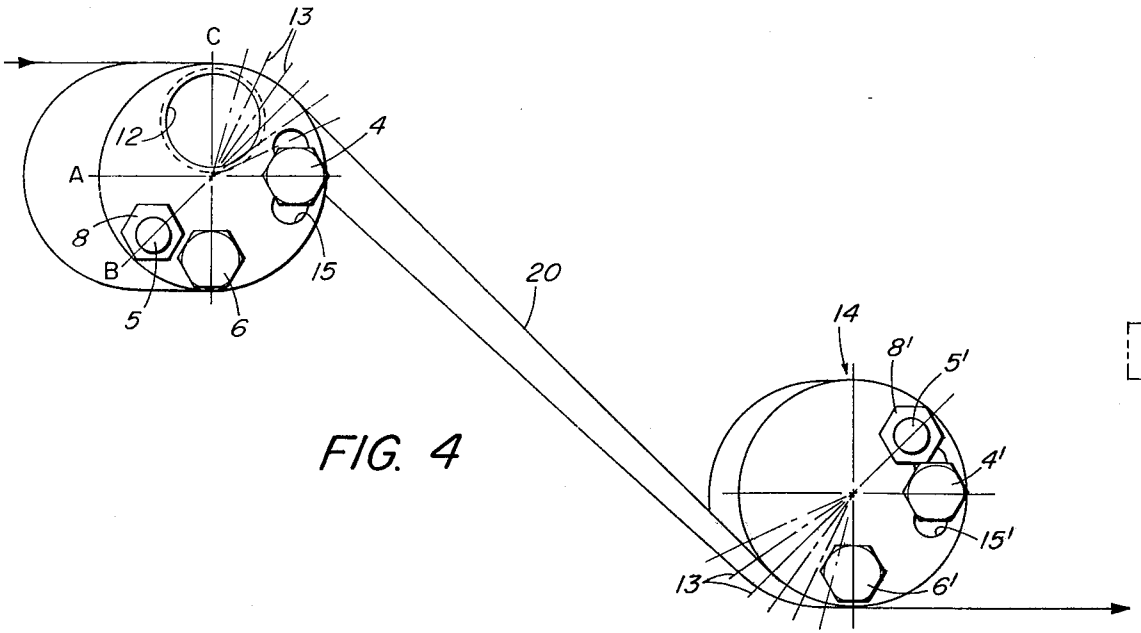
FIG. 4 is a schematic view in side elevation of a spreading device having two of the adjustable bow bars of FIGS. 1–3.
Figure 3:
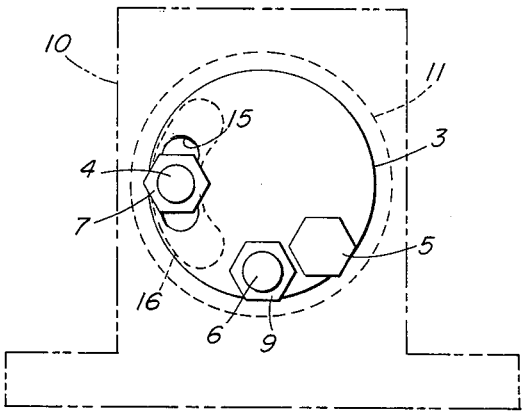
FIG. 3 is a view in right side elevation of the bar of FIG. 1.

FIG. 4 shows the manner in which two such bow bars are typically used, as further described, for example, in the aforementioned U.S. Pat. No. 3,463,377. The bar of FIGS. 1–3 is shown as the bar at the upper left of FIG. 4. The bar 14 at the lower right of FIG. 4 is similar except that the bolts 4', 5', and 6' are differently oriented from their counterparts 4, 5, and 6 because of the different manner in which the bar 14 is wrapped by a sheet 20 of longitudinally travelling paper, or other flexible material of indefinite length.

In use, the bolt 4 is used to introduce curvature or bow in the desired direction, and bolts 5 and 6 are used to prevent bow caused by sheet tension and axle weight respectively. Tensioning the bolt 4 by tightening its adjusting nut 7 introduces a uniform bending moment about the central axis of the shell 1, causing the shell to bow in substantially a circular arc in the direction shown in FIG. 4. The amount of bow produced is proportional to bolt tension. Similarly, tensioning the bolt 5 introduces a bending moment to oppose that produced by tension forces in the sheet 20, and its tension may therefore be adjusted substantially to cancel the effect of the latter moment, and thus eliminate the undesired bow which the latter moment would otherwise have produced. In like manner, the bolt 6 may be tensioned to eliminate the sag of the bar produced by its own weight.

In practice, it is frequently desired to change the tension in the sheet when changing grades of sheet, without an accompanying change in the desired bow setting. This can be accomplished with ease by adjusting only the tension in bolts 5 and/or 5', as this adjustment produces no interaction on the settings required of the bolts 4 and 6, and/or 4' and 6', respectively.

When it is desired to adjust the amount of bow, this can most easily be done with no sheet threaded through the machine. The nuts 7 and/or 7' are adjusted on the bolts 4 and/or 4' to produce the desired amount of bow, with the nuts 8 and/or 8' slack on the bolts 5 and/or 5'. The sheet is then threaded through the machine, the sheet tension is set as desired, and the bolts 5 and/or 5' are then set as required to eliminate any bow produced by sheet tension. The setting of the bolts 6 and/or 6' is not changed in this operation, since the sag which the weight of the bar tends to induce remains unchanged.

In the case of bars with a relatively short face length, the sag produced by the weight of the bar may be small enough to be ignored, and in such cases the bolts 6 and 6' are eliminated.

Theoretically, the described functions of the bolts 4, 5, and 6 could be performed by a single bolt, in a construction similar to that shown but with two of the three bolts simply eliminated. In theory, the sum of the moments required to cancel the effects of sheet tension and the weight of the bar, and to produce the desired bow, can all be combined to produce a single resultant bending moment. By locating the tensioning bolt in the plane of this resultant, the desired magnitude and direction of bow could be produced. However, the angular position of the bolt would have to be adjusted over a relatively large range, and the determination of the proper angular position and bolt tension would be an awkward and time-consuming procedure which would have to be repeated whenever bow or sheet tension was to be changed. The present invention permits the desired effect to be attained very simply, accurately, and quickly, and to be adjusted readily whenever the operating conditions are changed.

At times it may be desirable to rotate the direction of the bow of the bar with respect to the path of the sheet. For example, if the sheet tends to be loose in the middle and tight at the edges, the bow should be rotated slightly into the sheet until the longitudinal sheet tension is essentially uniform in all of the slit segments of the sheet. In conventional bow bars this is accomplished by simply rotating the whole bar in its brackets. However, when this is done the surface of the bar wrapped by the sheet also rotates, necessitating that extra air holes be provided to float the sheet regardless of the orientation (within usual limits of about ±10° from nominal) of the bow. This is, of course, wasteful of air. It would also disorient the bolts 5 and 6, so that they would no longer accurately correct bow caused by sheet tension and bar weight.

In the embodiment of my invention shown in FIGS. 1–4, the bolt 4 is mounted in curved slots 15 formed in each end cap 2 and 3. The center of curvature of the slot 15 is concentric with the axis of the bar 1, so that by appropriately positioning the bolt 4 within the slot 15, the direction of the desired bow may be adjusted as desired, typically up to ±10° from the nominal direction of bow. Since this is done without rotating the entire shell 1, extra air holes through the shell 1 are unnecessary, and the bolts 5 and 6 are not moved from their desired settings. Sealing plates 16, which are supported on the opposite ends of the bolt 4, act to seal the slots 15 against loss of pressurized air. The plates 16 are held against the inner faces of the end caps 2 and 3 by air pressure, assisted by compression springs 17, which in turn react against the collars 18 mounted on the bolt 4 near the end caps 2 and 3.

Figure 5:
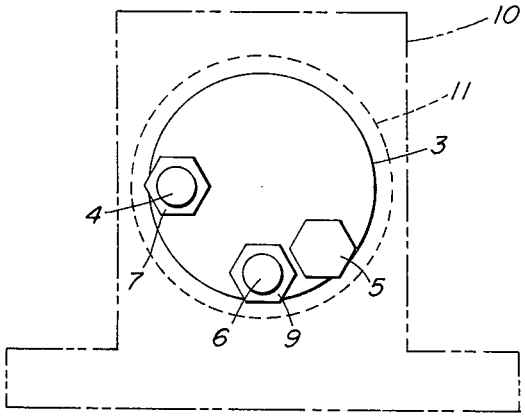
FIG. 5 is a view in right side elevation of a modified embodiment of the invention in an adjustable bow bar.

A modified construction of the invention is shown in FIG. 5. The elements of the bow bar are the same as in FIGS. 1–4, and cooperate in the same manner, except that the curved slots 15 are omitted, along with the accompanying sealing plates 16, springs 17, and collars 18. This construction achieves similar purposes to that of FIGS. 1–4, but does not provide the same ready adaptability to turning the bowed face of the bar with respect to the sheet in order to correct slackness of the center or edges of the sheet.

It should be understood that the bolts 4, 5, and 6 may be replaced by other well-known devices, such as hydraulic rams, for producing longitudinal compression or tension in the shell 1 along selected axes circumferentially spaced about and parallel to the major axis or centerline of the shell. If devices for applying tension rather than compression to the shell are used, these must act along axes lying in the planes A, B and C parallel to the centerline of the shell, but diametrically opposite to the illustrated locations of the bolts 4, 5, and 6. The bowing or bow-correcting effects of such tension devices would then be the same as those which have been described for the compression-applying tension bolts 4, 5 and 6.

Another embodiment of the invention in an adjustably-curved roll is shown in FIGS. 6–9. This roll has purposes similar to earlier adjustably-curved rolls shown, for example, in U.S. Pat. No. 2,547,975 of Apr. 10, 1951 and U.S. Pat. No. 2,689,392 of Sept. 10, 1954, both issued to J. Douglas Robertson and owned by the assignee of this application. These earlier types of rolls were, however, especially suitable for greater amounts of curvature, i.e., smaller radii of curvature, than the roll of FIGS. 6–9, which includes a hollow one-piece cylindrical shell or bar 28 that cannot, within its elastic limits, be bent as much as the multi-leaved axles of the earlier rolls. On the other hand, the one-piece shell 28 is of greater advantage where smaller curvatures are required, since it is not subject to the mechanical hysteresis which causes some uncertainty and variation in the amount of curvature of multi-leaved axles when they are readjusted.

The roll has a tubular sleeve 30 which is rotatably mounted on the axle 28 by suitable bearings (not shown) of a conventional nature, and carries an end cap 32 and a sheave 34 suitable for receiving a drive belt (not shown) for connection to external drive means for those applications in which extracting the drive torque from the sheet material passed over the roll is inappropriate. Sheet material (not shown) which is to be spread, expanded, or straightened in well-known fashion by the roll, is wrapped around an arcuate surface portion of the sleeve 30, passing over the sleeve parallel to its longitudinal axis in a similar fashion to the wrapping of the sheet 20 over the bars in FIG. 4. It should be noted that the device of FIGS. 6–9 is usable as a bow bar, simply by omitting the sleeve 30 and its end caps.

To bow the shell 28 into an adjustably-curved form, a pair of arms 46 are mounted near opposite ends of the shell 28 by means of cylindrical collars 44, received conformably about the shell and welded to the arms as at 47. A bending moment is applied by means of a bowing mechanism comprising an elongated bolt 52 secured to one of the arms 46 by a nut 54, and to the other arm by a differential screw device 48 of a conventional type, having an adjusting hex head 50. The device incorporates a driving screw (not shown) threaded inside and out, and attained to the head 50, and a driven screw threadedly engaged within the driving screw. The inner and outer threads are of the same hand but of different pitches, so that the inner driven screw advances relatively slowly, and a large mechanical advantage is secured. Rotation of the head 50 in one direction thus draws the arms 46 together with multiplied force, making it an easy matter to apply the large bending moment required to bow the shell 28. The shell bends in a plane defined by its major axis and by the centerline of the bolt 52, that is, in the plane of the paper in FIG. 6, and into an upwardly convex form.

Figure 6:
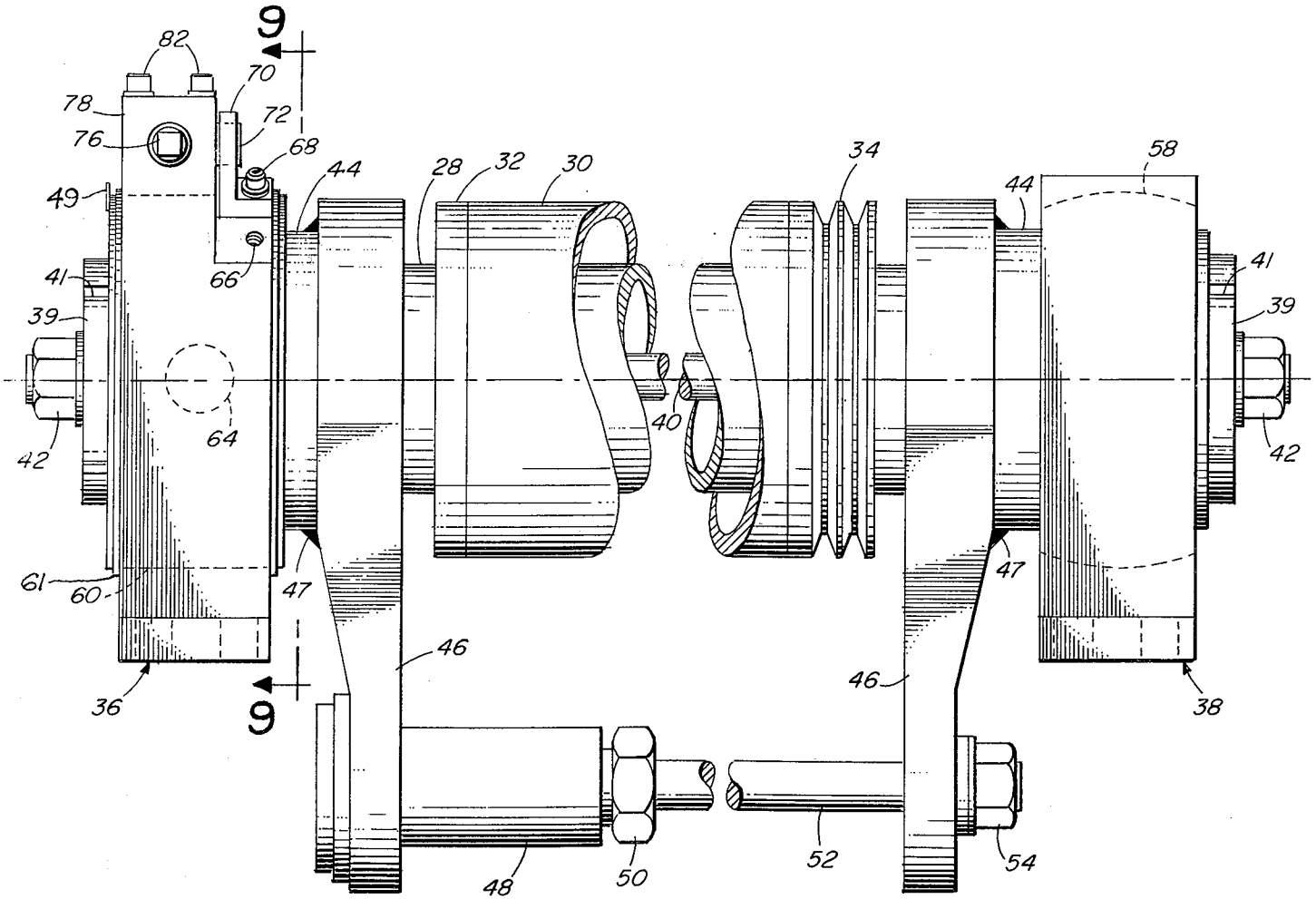
FIG. 6 is a fragmentary, partially sectional view in front elevation of another embodiment of the invention in an adjustable-bow roll.
Figure 8:
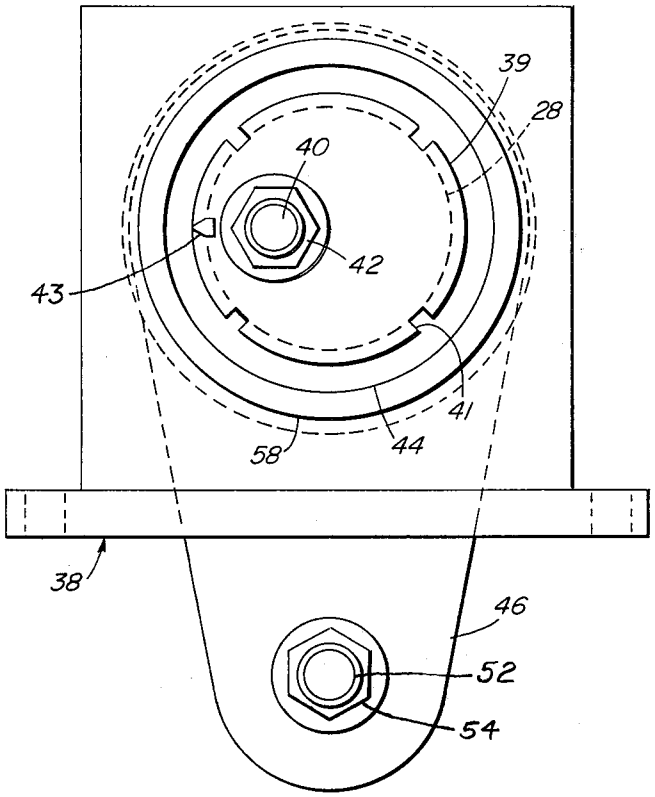
FIG. 8 is a view in right side elevation of the same roll.
Figure 7:
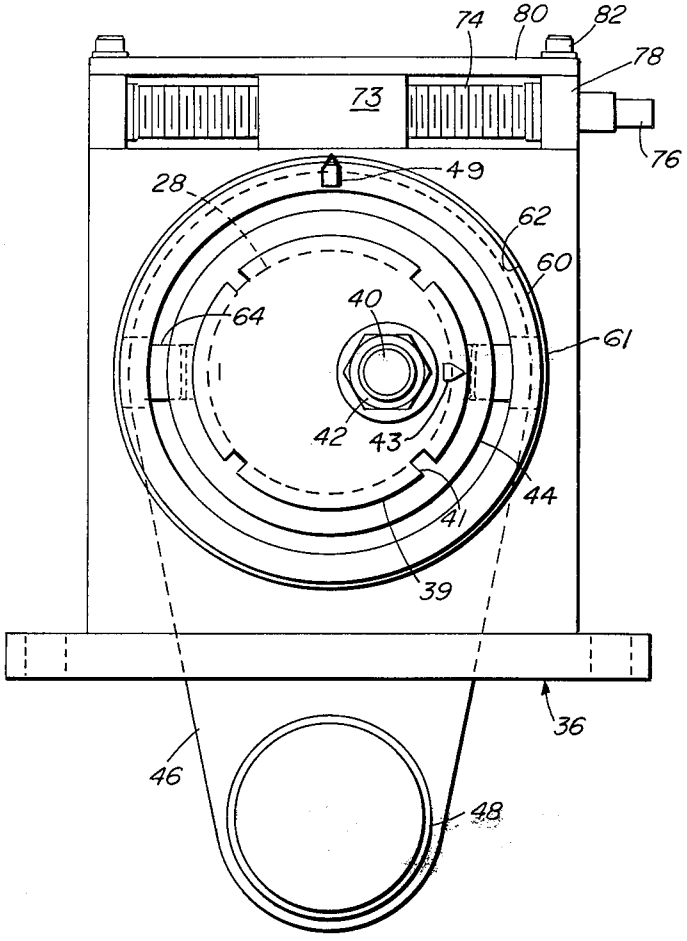
FIG. 7 is a view in left side elevation of the roll of FIG. 6.
Figure 9:
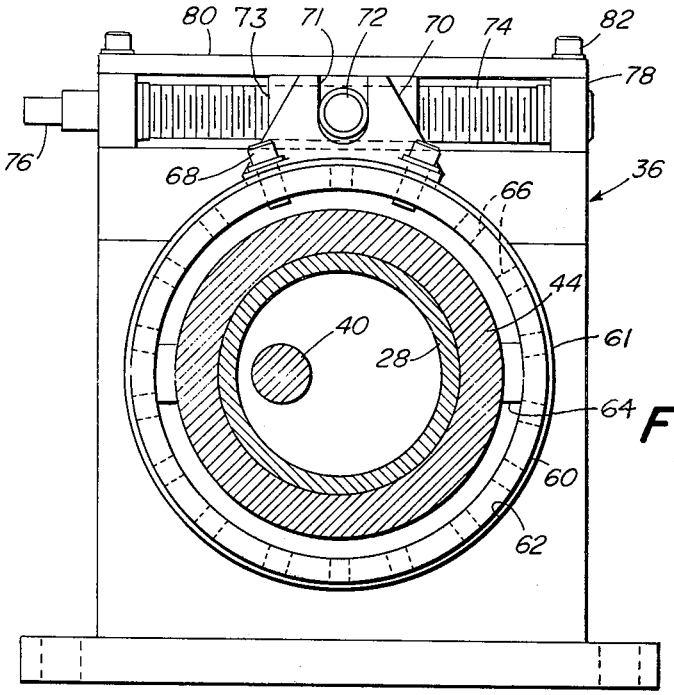
FIG. 9 is a sectional view taken along line 9—9 in FIG. 6, looking in the direction of the arrows.

At its right end, as viewed in FIG. 6, the shell 28 and the collar 44 are supported in a mounting block 38 by a spherical segment 58 of a conventional nature, which permits the shell to cant clockwise as its curvature increases.

At the left end, the shell and collar are supported in a mounting block 36 of special construction, which includes convenient means for changing the direction of the plane of curvature of the shell. As is well known in the art, it is often desirable to change the arcuate portion of the curved surface of the roll or bar which contacts the sheet material, in order to alter the spreading action. To this end, the collar 44 and the connecting arm 46 are drivingly connected for angular movement with a ring 60 by a pair of trunnion pins 64. These pins also mount the collar and shell for canting movement relative to the block 36 about a diametral axis, to accommodate bending of the shell. The ring 60 is held in the block 36 by retaining rings 61.

The ring 60 is rotatably received in a bore 62 in the mounting block 36, and bears a bifurcated bracket 70, having a slot 71 in which a locating pin 72 is slidably received. The bracket 70 is attached to the ring by a pair of screws 68 threaded into a selected pair of a plurality of tapped holes 66 spaced around the ring. The improved adjusting device is capable of turning the shell and its plane of curvature through only a limited arc; displacements through larger angles are accomplished by removing the screws 68, bodily turning the shell 28 to a new angular position, and reinserting the screws into a new pair of tapped holes 66.

To turn the shell through a smaller arc of adjustment, the pin 72 is mounted on a nut 73 which is threaded on an adjusting screw 74 having a squared end 76 for receiving an adjusting wrench. The screw 74 is journalled in blocks 78 connected by a strap 80 and attached to the mounting block 36 by screws 82. Turning the screw 74 translates the pin 72 to right or left, and accordingly cocks the bracket 70, the ring 60, the collars 44, and the shell 28 through an arc of limited extent to effect moderate adjustments in the plane of roll or bar curvature. An indicator 49 is mounted on the ring 60 to show the location of the plane of curvature more clearly, and index marks (not shown) may be formed on the underlying surface of the mounting block 36 if desired.

A tension bolt 40 extends longitudinally through the interior of the shell 28 and through end caps 39 at either end. Nuts 42 are threaded on either end of the rod to exert an adjustable degree of compression eccentrically on the shell, along the centerline of the bolt 40, to correct unwanted bowing of the shell in a plane defined by the parallel centerlines of the shell and the bolt. The end caps are received rotatably in the ends of the shell, so that the bolt can be adjusted to any angular position when the nuts 42 are slacked off, and the caps have notches 41 to receive a spanner wrench to facilitate this adjustment. The bolt is turned to lie in the plane of, and diametrically opposite to, whatever resultant force against which it is desired to straighten the shell, whether this be the tension force in the sheet material, the weight of the shell and the sleeve 30, or both, in the same manner as has been explained for the bar of FIGS. 1–5.

Indicators 43 are attached to the end caps 39 to aid in showing the exact angular position of the bolt 40, and index marks (not shown) may be formed on the underlying surfaces of the collars 44 if desired.

Figure 10:
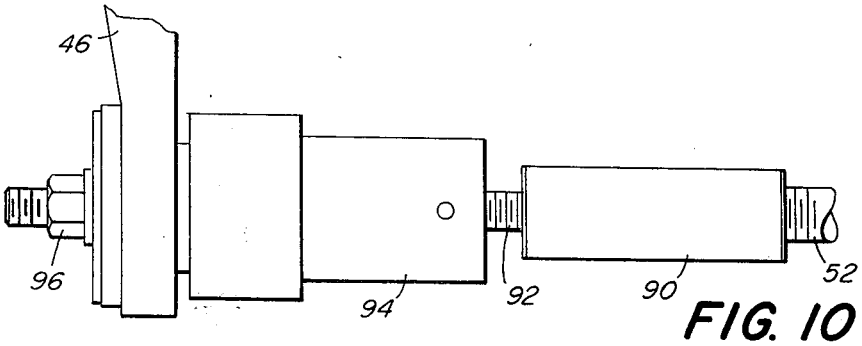
FIG. 10 is a fragmentary view in front elevation of an embodiment including a modified bending device.
Figure 11:
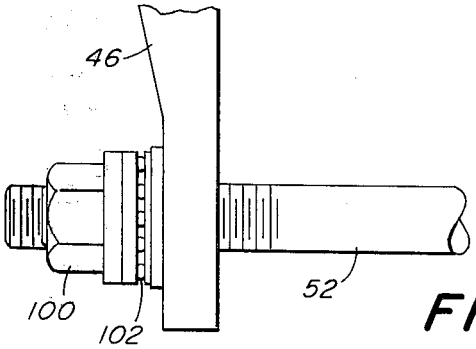
FIG. 11 is a fragmentary view in front elevation of another embodiment having another bending device.

FIGS. 10 and 11 show modifications of the construction of FIGS. 6–9, like parts having the same numbers.

In FIG. 10, the differential nut 48 is replaced by an hydraulic ram 94 attached to the left-hand arm 46 by a nut 96, and to the bolt 52 by a stud 92 and an adjusting nut 90, which allows the length of the bowing mechanism between the arms 46 to be adjusted when pressure fluid is exhausted from the ram. In FIG. 11, a plain nut 100 is threaded directly on the bolt 52, and a ball thrust bearing 102 is interposed between this nut and the arm 46 to reduce the torque required to adjust the bowing mechanism.

What I claim is:

1. An adjustable-bow device having an arcuate outer surface portion adapted for wrapping by an indefinite length of sheet material wrapped partially thereabout, said device comprising a hollow cylindrical shell having a major longitudinal axis, and means for supporting said shell with a predetermined angular orientation;

first means for applying adjustable longitudinal stress to said shell along a first axis parallel to and spaced apart from said major axis, said first stress-applying means being constructed and arranged to bow said shell parallel to a first plane defined by said first axis and said major axis;

said shell being subject to a resultant force applied to said shell and lying in a second plane defined by said major axis and a second axis parallel to and spaced apart from said major axis, said resultant force tending to induce undesired curvature in said shell parallel to said second plane;

and second means constructed and arranged for applying adjustable longitudinal stress to said shell in said second plane and in opposition to said resultant force to remove said undesired curvature from said shell.

2. An adjustable-bow device as recited in claim 1, said first and second stress-applying means being relatively angularly adjustable with respect to one another about said major axis.

3. An adjustable-bow device as recited in claim 1, at least one of said stress-applying means being angularly adjustable about said major axis with respect to said shell.

4. An adjustable-bow device as recited in claim 1, said first and second stress-applying means being independently angularly adjustable about said major axis with respect to said shell.

5. An adjustable-bow device as recited in claim 1, together with third means for applying longitudinal stress to said shell along a third axis parallel to and spaced apart from said major axis, said third axis lying in a vertical plane passing through said major axis, and being constructed and arranged to remove curvature induced in said shell by the weight thereof.

6. An adjustable-bow device as recited in claim 1, said shell being provided with end caps, at least one of said stress-applying means comprising a tension bolt passing through said end caps.

7. An adjustable-bow device as recited in claim 6, said end caps and said bolt being jointly angularly movable relative to said shell to relocate said second plane.

8. An adjustable-bow device as recited in claim 6, the other of said stress-applying means comprising a second tension bolt exterior to said shell and a pair of arms attached to opposite end portions of said shell, extending radially therefrom, and attached outwardly from said shell to opposite end portions of said second bolt.

9. An adjustable-bow device as recited in claim 1, said shell being provided with end caps, said first and second stress-applying means comprising tension bolts passing through said end caps, said end caps being formed with arcuate slots receiving one of said stress-applying bolts, said slots being generated by circular arcs about said major axis; whereby said first and second planes may be relatively angularly displaced by moving said one stress-applying bolt without angular displacement of said shell and the other said stress-applying bolt.

10. An adjustable-bow device as recited in claim 9, together with a pair of sealing plates for said slots, said sealing plates being supported on said one stress-applying bolt and being movable therewith to hermetically seal said slots.

11. An adjustable-bow device as recited in claim 8, together with means for sealing said slots against the escape of air therefrom, said arcuate outer surface portion of said shell being formed with a plurality of air holes, whereby air supplied to the interior of said shell passes through said holes to form an air cushion between said shell and said sheet material.

12. An adjustable-bow device as recited in claim 1, said supporting means mounting said shell and said first stress-applying means for joint angular displacement about said major axis of said shell, and including means for angularly adjusting said shell and said first stress-applying means to relocate said first plane.

13. An adjustable-bow device as recited in claim 12, said second stress-applying means being angularly adjustable independently of said shell and said first stress-applying means to relocate said second plane.

* * * * *

UNITED STATES PATENT AND TRADEMARK OFFICE

CERTIFICATE OF CORRECTION

PATENT NO. : 3,940,043
DATED : February 24, 1976
INVENTOR(S) : Robert E. Staples It is certified that error appears in the above-identified patent and that said Letters Patent are hereby corrected as shown below:

Column 2, line 12, change "applied" to --applies--.

Column 4, line 13, change"adjusted" to --adjustable--.

Column 5, line 55, change "attained" to --attached--.

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*